United States Patent [19]

Yamauchi et al.

[11] Patent Number: 4,811,780

[45] Date of Patent: Mar. 14, 1989

[54] CONTINUOUS CASTING APPARATUS FOR METAL STRIP

[75] Inventors: Takashi Yamauchi; Morihiro Hasegawa; Ryuichi Akiyama, all of Yamaguchi, Japan

[73] Assignee: Nisshin Steel Co., Ltd., Tokyo, Japan

[21] Appl. No.: 171,470

[22] Filed: Mar. 21, 1988

[30] Foreign Application Priority Data

Apr. 8, 1987 [JP] Japan ..... 62-84555

[51] Int. Cl.[4] ..... B22D 11/06

[52] U.S. Cl. ..... 164/428; 164/480

[58] Field of Search ..... 164/428, 480

[56] References Cited

U.S. PATENT DOCUMENTS 4,754,802 7/1988 Yamauchi et al. ..... 164/428

*Primary Examiner*—Kuang Y. Lin

*Attorney, Agent, or Firm*—Wenderoth, Lind & Ponack

[57] ABSTRACT

A continuous casting apparatus for continuously casting metal strip through a gap between a pair of opposite internal cooling rolls rotating in the opposite direction to each other, wherein side dams have the bottom surfaces contacting the circumferential surfaces of both rolls and made of refractories having satisfactory abrasiveness, and a mechanism is provided for feeding the side dams in the casting direction at a predetermined speed, the circumferential surface portion of the roll contacting the side dam being formed into a rough surface having grindability, whereby the movement of the side dam by the feeding mechanism is carried out through the wear of the side dam caused by the grinding of the rough surface.

3 Claims, 3 Drawing Sheets

CONTINUOUS CASTING APPARATUS FOR METAL STRIP

This invention relates to improvements on a twin roll type continuous casting apparatus for continuously casting metal strip directly from molten metal.

It is well known a so-called twin roll type continuous casting apparatus in which a pair of internal cooling rolls having respectively horizontal axes and rotating in the opposite directinn to each other are disposed parallel to each other by leaving a proper gap therebetween, a metal pool is formed on the circumferential surfaces (the upper halves of cylindrical surfaces in the axial directions) of rolls above the gap and molten metal in the metal pool is continuously cast into a metal strip through the gap while cooling the molten metal by the circumferential surfaces of rotating rolls. There has also been proposed such a twin roll type continuous casting apparatus applied to a case of continuous casting of steel to produce steel strip directly from the molten steel.

When steel strip products are continuously cast through the gap between a pair of rolls at all times, it is necessary to form a metal pool as pouring basin for molten metal on the circumferential surfaces of the pair of rolls above the gap therebetween, thereby continuously pouring the molten metal into the metal pool so as to maintain the level of molten metal substantially constant. In order to form the metal pool, a pair of dams are always required which regulate the outflow of molten metal along the roll axes on the circumferential surfaces of rolls and have their surfaces perpendicular to the roll axes respectively. These dams also serve usually to regulate the width of cast strip. In this specification, these dams are referred as "side dams". In addition to these dams disposed at the left and right sides, a pair of front and rear gates having their surfaces along the roll axes may be erected orthogonally to the side dams on the circumferential surfaces of the pair of rolls to form a box-like metal pool with the side dams and the front and rear gates. However, when the pair of rolls have sufficiently large radii respectively, the front and rear gates along the roll axes are not always needed. In this case, the circumferential surfaces of the pair of rolls may fulfill by themselves respective parts of the front and rear gates.

There are known, as the pair of side dams, movable side dams which urge an endless metal belt, caterpillar or the like against the sides of the pair of rolls and move at a speed corresponding to the casting speed of cast strip, and fixed side dams which have plate-like bodies of refractories fixed to the left and right sides of the pair of rolls. Generally, with the latter fixed side dams, the constitution of the apparatus becomes simple and the control of running is not complicated, compared with the former movable side dams.

Two systems of the fixed side dams are well known as follows. One is a system in which the distance between the refractories of the both side dams opposed to each other is smaller than the roll width (the length of roll from one end to the other end), and the other is a system in which the distance is equal to the roll width. According to the former system, the both side dams are erected on the circumferential surfaces of the pair of rolls such that the bottoms of the both side dams slidably contact the circumferential surfaces of the rolls. According to the latter case, the side dams are fixedly provided so that the respective inside surfaces of the both side dams slidably contact the both sides of the rolls (in this specification, both sides of rolls are referred as roll side surfaces) perpendicular to the roll axes, i.e., the both side dams sandwich the both ends of the pair of rolls. Also, as disclosed in Japanese Patent Publication Laid-open No. 130450/85, an example of specific fixed side dam is known in which the side surfaces of twin rolls are not arranged on one plane, but the rolls having the same length are arranged in parallel crosses (located staggered axially) to project the side surface of one roll from the side surface of the other roll so that the fixed side dam slidably contacts the circumferential surface of one roll and the side surface of the other roll.

In either cases, a portion of molten metal in the metal pool forms thin solidified shells respectively on the surfaces of rotating rolls, and then these shells pass through the gap between the twin rolls while growing along with rotation of the rolls. At this time, the solidified shell is depressed (rolled) at a portion in the neighborhood of the smallest gap between the rolls to form into a predetermined thickness of metal strip. Thus, owing to squeeze (rolling) of the solidified shell, the solidified shell tends to expand widthwise near the roll gap. As a result, the ends of cast strip apply large pressure to the fixed side dams to generate large friction beteeen the end of moving strip and the fixed side dams.

Usually, refractories with excellent adiabatic property are suitable for materials used for the fixed side dams since the molten metal contacting the side dams has to be prevented from the solidification on the surfaces of the side dams. Such adiabatic refractories have generally the antiwear property inferior than that of solidified metal and are liable to have scratches. Thus, the refractories may be damaged by the friction noted above and the increase of damages brings about the break-out of molten metal. Further, according to the system noted above in which the side dams are fixed such as to sandwich the roll side surfaces of the both rolls, a gap is produced between the roll side surfaces and the inside surfaces of the side dms slidably contacting therewith due to pressure of the ends of strip applied at the time of passing the strip ends through the roll gap, and then the molten metal enters the gap. When these troubles occur, the stable casting may not be continued.

An object of the present invention is to overcome the problems noted above in the twin roll type continuous casting apparatus provided with the fixed side dams made of refractories on the left and right of the twin rolls.

According to the present invention, there is provided a continuous casting apparatus for metal strip, in which a pair of internal cooling rolls rotating in the opposite direction to each other are disposed opposite to each other with their axes being directed horizontally, and a pair of side dams spaced from each other by a distance approximately corresponding to the width of cast strip are disposed in order to form a metal pool on the circumferential surfaces of the pair of rolls, thereby continuously casting molten metal in the metal pool into metal strip through the gap between the pair of rolls, said continuous casting apparatus being characterized in that the side dams are disposed such that at least a portion of the bottom of the side dam contacts the circumferential surface of the roll so as to allow a portion or the whole of the thickness of the side dam to locate on the circumferential surface of the roll, the bottom portion of the side dam at least contacting the circumferential surface of the roll is made of refractories with satisfactory abrasiveness, a mechanism is provided for feeding the side dams in the casting direction at a predetermined speed, and the circumferential surface portion of the roll contacting the side dam is formed into a rough surface having grindability, whereby the movement of the side dam by the feeding mechanism is caused by the wear of the side dam due to grinding with the rough surface.

More specifically, the side dams are positively moved in the casting direction, differing from prior fixed side dams. However, the moving speed does not correspond to the casting speed of cast strip, compared with that of prior movable side dams, but is far slower than the casting speed to move the side dams in the casting direction. And the movement of the side dams are carried out along with the wear of the side dams. A portion of the side dam at least contacting the circumferential surface of the roll is made of a material having high abrasiveness. Then, during the running of the apparatus, the side dams are fed in the casting direction at a predetermined speed to grind the side dam portions contacting the circumferential surfaces of the rotating rolls due to the roll circumferential surfaces and to simultaneously carry out casting. To aid this grinding, the circumferential surfaces of the rolls contacting the side dams are preferably formed with a rough surface having grindability. Since the side dams installed according to the present invention need to have portions contacting the circumferential surfaces of the rolls, the side dams are erected on the circumferential surfaces of the rolls so as to allow portions of the side dams to at least contact the roll circumferential surfaces. At this time, only one portion of the side dam thickness is adapted to contact the circumferential surface of the roll on the bottom portion and the other portion of the thickness is adapted to project outward from the width of the roll. Then, the side dam area of the thickness at outward projecting portion (as viewed in the axial direction of roll) is made larger than that of the former portion contacting the circumferential surface of the roll while the internal surface of the side dam at this projecting thickness portion may slidably contact the side surface of the roll.

Accordingly, with a preferred embodiment of the side dam according to the present invention, only a portion of the thickness of the side dam is gradually ground during the operation of the apparatus. That is, one portion of the thickness of the side dam contacts the circumferential surface of the roll on the bottom portion and the other portion of the thickness projects outward from the roll width. Therefore, casting is carried out under such state that the side dam area of the thickness at the outward projecting portion is made larger than that of the former portion contacting the circumferential surface of the roll and the internal surface of the side dam at the outward projecting thickness portion slidably contacts the side surface of the roll. In this case, the whole side dam may be constituted by a high abrasiveness refractory material and the outer surface of the side dam made of this refractory material may be covered with a side dam case to support the whole side dam, the side dam case being connected with a mechanism for moving the side dam case in the casting direction.

One of characteristics of the apparatus according to the present invention is that the bottom surface of the side dam contacting the circumferential surface of the roll is ground by the rough circumferential surface of the roll, and the inner surface of the side dam is simultaneously ground by an end of cast strip while applying resistance to cast strip end to prevent the same from large widthwise expansion. This feature of the invention will be particularly understood by the description with reference to the accompanying drawings. Generally speaking, a portion of molten metal is solidified into thin shells on the surfaces of the both internal cooling rolls and the shells are thickened as the rolls are rotated. When the shells pass through the gap between the rolls, the united solidified shells are pressurized to expand widthwise, so that the inner surface of the side dam near the narrowest gap between the rolls will be ground by the expanded end of the solidified shells which form and shape into cast srip. According to the present invention, the side dam is moved in the casting direction so as to correspond the degree of the inner grinding to that of grinding the bottom surface of the side dam contacting the circumferential surface of the roll by the circumferential surface of the roll. Thus, the inside material of the side dam contacting the end of the cast strip may be also made of a refractory material which will be ground by the end of the cast strip. The portion of the side dam contacting the circumferential surface of the roll and the portion of the side dam contacting the end of the shells or the cast strip will be ground together in the normal casting while the moving speed of the side dam is determined so as to maintain the shapes of these portions substantially similar.

Accordingly, the present invention also provides a continuous strip casting method in which a pair of internal cooling rolls rotating in the opposite direction to each other and having the horizontal axes are disposed opposite in each other, and a pair of side dams are disposed spaced from each other by a distance approximately corresponding to the width of cast strip in order to form a metal pool on the circumferential surfaces of the pair of rolls, thereby continuously casting the molten metal in the metal pool into strip through the gap between the pair of the rolls, said method being characterized in that the side dams having satisfactory abrasiveness and contacting the circumferential surfaces of the rolls on at least a portion of the bottom are disposed to locate a portion or the whole of thickness of the side dam on the circumferential surface of the roll and moved in the casting direction in the normal casting at such speed that the bottom surface of the side dam contacting the circumferential surface of the roll and the inner surface of the side dam contacting the end of solidified shell or cast strip are ground while maintaining the shapes of these surfaces substantially similar.

Hereinafter will be described a preferred embodiment of the twin roll type continuous casting apparatus according to the present invention with reference to drawings, in which.

Figure 1:
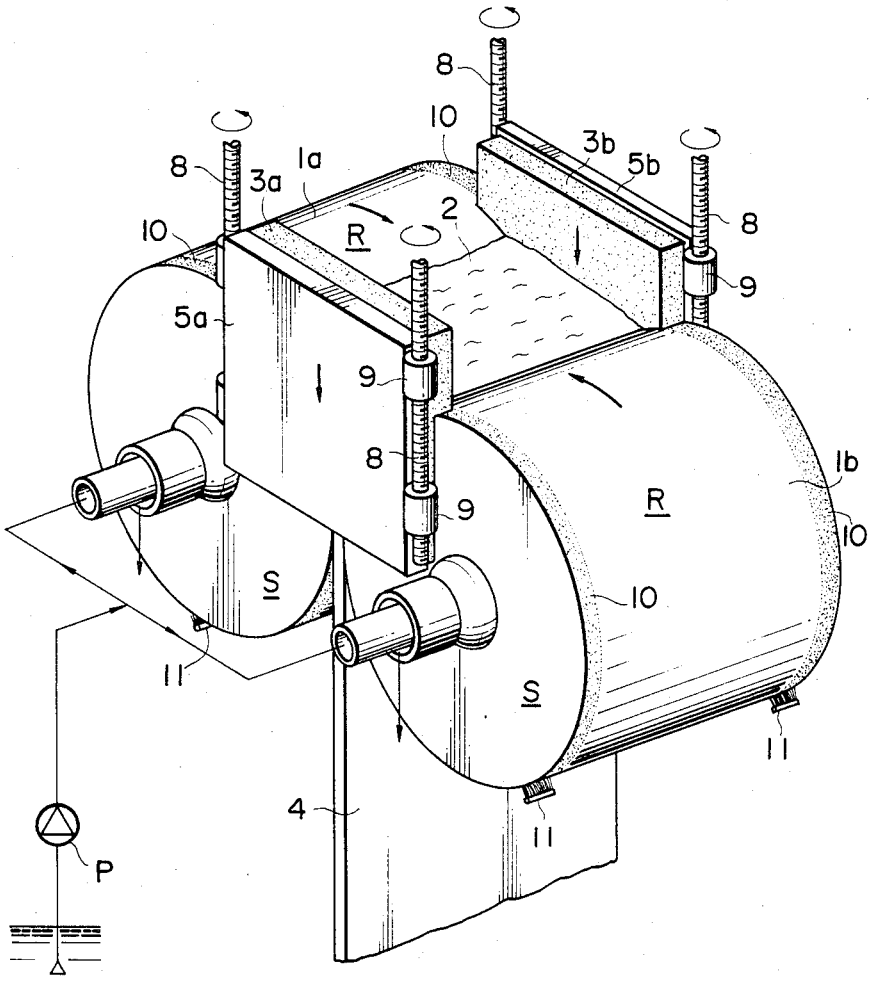
FIG. 1 is a perspective view showing principal portions of an embodiment of an apparatus according to the present invention.

Referring to FIG. 1, reference numerals 1a,1b designate a pair of internal cooling rolls rotating in the opposite direction to each other (the rotational directions of both rolls are shown by arrows) and disposed opposite to each other with their roll axes held horizontally. Reference numeral 2 designates molten metal in a metal pool formed on the circumferential surfaces R of the pair of rolls 1a,1b, 3a,3b side dams and 4 cast strip, respectively.

The pair of rolls 1a,1b are internal cooling rolls. Either of examples shown in the drawings uses water cooling rolls. More particularly, the pair of rolls 1a,1b are formed on the insides of drums constituting the circumferential surfaces R with cooling water paths (not shown). The circumferential surfaces R are adapted to be cooled to a predetermined temperature by water passing through the cooling water path. Cooling water is supplied to and drained from the cooling water path on the insides of the circumferential surfaces R through roll shafts. Thus, the roll shaft is of a double pipe constitution. An inner pipe serves as a cooling water supply pipe and an annular pipe path which is formed between outer and inner pipes serves as a drain pipe. In the interior of the roll, the cooling water supply pipe which is the inner pipe is connected to a cooling water path inlet which is provided inside the circumferential surface R. The annular pipe path is connected to a cooling water outlet. When cooling water is continuously supplied from a pump P into the inner pipe according to the constitution as shown in the drawing, the supplied cooling water is circulated through the cooling water path located inside the circumferential surface R and then drained through the annular pipe path. The operation of passing the cooling water may be carried out continuously even in the running of the apparatus.

Figure 2:
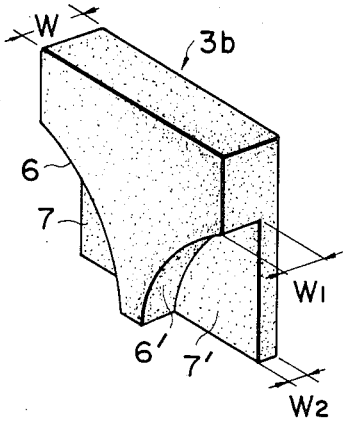
FIG. 2 is a perspective view showing an example of shape of refractory side dam of the apparatus in FIG. 1.

The side dams 3a,3b are grasped by metal side dam cases 5a,5b mounted on the outside surfaces of the side dams and moved in the casting direction. The side dams 3a,3b themselves are made of refractories. The shapes of these side dams are as shown in FIG. 2. One inner portion $W_1$ of the whole thickness W corresponds to the thickness of a portion installed on the circumferential surface R of the roll and the other outer thickness $W_2$ corresponds to the thickness of a portion installed out of the circumferential surface of the roll as shown in FIG. 2. Namely, the inner thickness portion $W_1$ has bottom surfaces 6,6' worked to have curved surfaces corresponding to the circumferential shapes of the rolls 1a,1b and the outer thickness portion $W_2$ is shaped to form portions 7,7' slidably contacting the side surfaces (shown by reference symbol S in FIG. 1) of the rolls 1a,1b and extending to portions lower than said bottom surfaces 6,6'.

As shown in FIG. 1, on the outer surfaces of the refractory side dams 3a,3b which are shaped as shown in FIG. 2 are mounted the metal side dam cases 5a,5b to cover wholly the outer surfaces for grasping the side dams 3a,3b. In this case, the bottom surfaces 6,6', which are curvedly worked of the thickness portion $W_1$ contact the circumferentail surfaces R of the rolls 1a,1b, and the inner surfaces 7,7' of the thickness portion $W_2$ slidably contact the side surfaces S of the rolls 1a,1b. Then, the side dam cases 5a,5b are supported by a plurality of struts 8 with screws through nuts 9 fixed to the case side. Each strut 8 is rotated about its own axis to move the side dam cases 5a,5b in the casting drrection. Thus, the side dams 3a,3b during the running of the apparatus are lowered together with the bottom surfaces 6,6' being ground by the circumferential surfaces R of the rotating rolls. The side dam cases 5a,5b are preferably bonded to the side dams 3a,3b at the connective interface between both cases and dams by the use of adhesives other than mechanical engagement and others. Thus, the side dam refractories with generally low tensile strength are reinforced. A system of continuously lowering the side dam cases 5a,5b in the running of the apparatus is preferable used for a mechanism for moving the side dam cases 5a,5b downwardly. However, an intermittent moving system for repeatedly lowering and stopping, or a system for lowering with slight oscillation may be employed, if necessary. In any case, the lowering speed of the side dam is preferably controlled according to the detecting signal of lowering amount of the side dam or the width of cast strip.

On the other hand, portions of the circumferential surfaces R of the rolls slidably contacting the bottom surfaces 6,6' of the side dams are preferably formed into rough surfaces having grindability. The rough surface portions (4 portions) are designated by reference numeral 10 in FIG. 1. The roughness and hardness of these portions should be selected according to the material and lowering speed of the side dam. The rough surface is made properly by methods of emery polish, sand blast treatment, molten metal injection treatment, etc. Either of thsse methods will do which provides high grindability and few wear. Also, at least one brush 11 for one circumference of each rough surface 10 may be mounted to slidably contact the portions 10 of the rough surfaces of the rolls 1a,1b, and thereby to prevent the portions 10 of the rough surfaces from choking up with ground powder. In place of the brush 11 may be used a vacuum cleaner which cleans the portions 10 of the rough surfaces.

Though refractories are proper material used for the side dams 3a,3b which must be satisfactorily adiabatic, they must have also satisfactory abrasiveness according to the present invention. Because the bottom surfaces 6,6' need to be ground by the rough surfaces 10 on the circumferential surfaces and further the side dams should be preferably made of such material to be easily ground by the end of solidified shell or cast strip. The proper materials used for the side dams are adiabatic bricks, ceramic fiber boards, boron nitride (BN), etc. which have a better abrasiveness. In the apparatus shown in FIG. 1, the whole side dams 3 configured as shown in FIG. 2 may be made of refractories containing mainly boron nitride.

Figure 3:
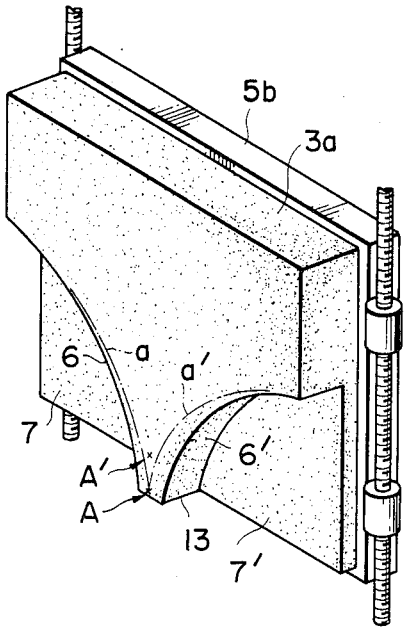
FIG. 3 is a perspective view showing the side dam of the apparatus in FIG. 1 under the condition that the degree of grinding is small in the early period of casting.

FIG. 3 shows the internal surface condition of the side dam according to the present invention in the early period of casting. The side ends of solidified shells formed on the surfaces of the twin internal cooling rolls will contact the internal surfaces of the side dams on the level shown by reference symbols a,a' in the drawing while being combined at point A. Namely, a portion of molten metal in the metal pool is cooled on the surface of each roll and then solidified into thin shells. Then, both solidified shells grow and combine with each other along with the rotation of the roll. When the combined shells are rolled to a predetermined thickness of cast strip through the gap between the rolls, the ends of the shells will be pressurized to expand widthwise. The early configuration of the side dam (before the side dam is ground during the running of the apparatus) is determined such that the confluence A (solidification completing point) of the solidified shells is located near lower edges 13 of the side dams within the roll width ($W_1$ in FIG. 2). In the casting, the confluence A may be moved to a position A' above the position of the lower edge 13 due to the variation of casting requirements. In this case, the corresponding portions of refractories will be ground by the widthwise expansion of strip (metal strip solidified after passing through the confluence A) produced through rolling of the roll. Unless the side dams are lowered under such conditions, the strip width is gradually increased. When the strip width exceeds the roll width, the exceeding portion of the strip is formed into such shape that a dog's bone like end of the strip is swollen in section, and in the further proceeding of casting, the side dams will be damaged, resulting in the breakout of molten metal. Since the side dams are lowered at a predetermined speed according to the present invention, other surfaces of the side dams are newly successively lowered even if said exceeding portions are ground by the plate ends. Therefore, metal strip of a predetermined plate width will be always cast without causing these situations.

Figure 4:
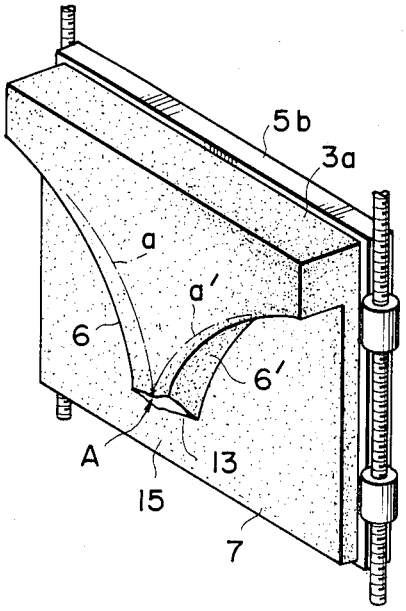
FIG. 4 is a perspective view showing the side dam of the apparatus in FIG. 1 under the condition that the degree of grinding is proceeded in the casting process.

FIG. 4 shows the internal surface of the side dam when the side dam is considerably lowered in the proceeding of casting. While the bottom surfaces 6, 6' and the lower edges 13 are ground by the rough surfaces 10 of the rolls and the side ends of the cast strip respectively and their positions are moved upward relatively to the early positions shown in FIG. 3, the lower edges 13 are ground into the somewhat slant condition by the solidified shell or strip ends. And the internal surface 15 of portions of refractories projecting from the roll width will be exposed at the lower portions of the lower edges 13 so that these portions serve to prevent the molten metal from any possible leakage. However, even if the bottom surfaces 6,6' and the lower edges 13 are ground off, the side ends of the solidified shell will also contact the side dams at the level shown by a,a' in the drawing while being combined at the point A.

Figure 5:
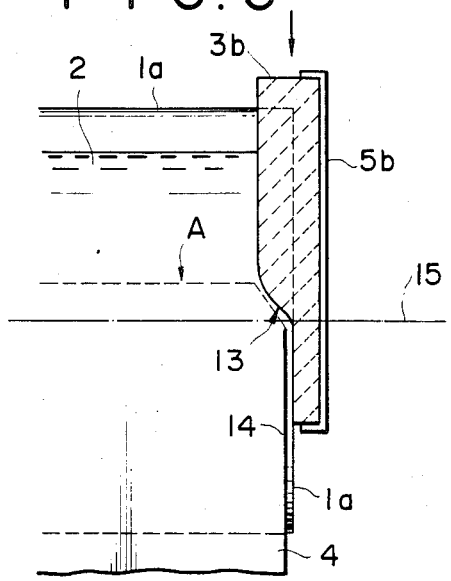
FIG. 5 is a fragmentary schematic sectional view showing the casting condition of the apparatus according to the present invention, as viewed in a plane parallel to cast strip.

FIG. 5 shows schematically the process of casting corresponding to that in FIG. 4. As shown in FIG. 5, the lower edges 13 may be maintained in the positions above the narrowest gap (at the center level of roll shaft 15) between the twin rolls by moving (lowering) forcibly downward the side dams, while the lower edges 13 are ground into sloped shapes. Thereby, the widthwise expansion of strip ends 14 passing through the confluence (solidification completing point) A of the solidified shell is restrained. If the side dams are set to the certain fixed positions without lowering them, it will be understood that the internal surfaces of the side dams will be successively ground by the shell and strip ends 14 which are expanded widthwise at the narrowest gap and eventually the molten metal will leak from the side dam portions which are ground when the strip width exceeds the roll width. This occurs not only in the case of refractories with satisfactory abrasiveness, but also in the case of general refractories. When refractories having antiwear property are used, cracks take place, resulting in more dangerous conditions. Contrarily to the prior conception of using refractories with antiwear property, the present invention uses the side dams made of refractories which are liable to be ground. Then, the side dams forcibly lowers to positively grind refractories. As a result, the stable casting may be carried out without presenting the above mentioned problems by employing such lowering speed that the bottom surfaces 6,6' of the side dams contacting the circumferential surfaces of the rolls and the internal surfaces (substantially near the lower edges 13) of the side dams contacting the shell and cast strip ends are ground while maintaining the shapes of these bottom and internal surfaces of the side dams substantially similar, more particularly, by employing such lowering speed that the grinding speed of the shell and strip ends near the lower edges 13 does not exceed the grinding speed of the bottom surfaces 6,6' of the side dams, i.e., by allowing the side dams to lower such that the latter speed becomes higher than the former speed. Further, in order to achieve this casting, it is necessary for the side dams to be installed in such state that at least a portion of thickness of the side dam exists within the roll width.

When the side dams are lowered at a proper speed according to the present invention, the lower edges 13 of the side dam may realize the normal condition so as to maintain the shapes of the lower edges fixedly. Thus, when the previously elongated side dams are lowered, the stable casting may be carried out for a long period of time. In this case, the strip width is constant from beginning to the end of the operation. While the lowering speed of the side dams cannot be specified due to difference of the casting requirement, 50 mm/min or less lowering speed is often proper generally.

Figure 6:
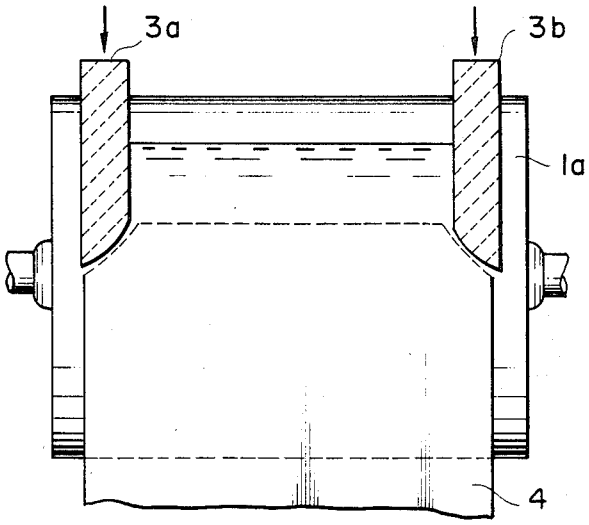
FIG. 6 is a schematic sectional view showing another example of the side dam of the apparatus according to the present invention, as viewed in the plane parallel to the cast strip.

Further, while heretofore has been described an example of the side dams having one portion of thickness within the roll width and the other portion of thickness outside the roll width, the present invention may also be applied to a system in which the whole thickness of the side dam comes within the roll width. FIG. 6 shows this example. As shown by the arrow in this case, the side dams *3a,3b* are provided to be moved downwardly ad the side dams *3a,3b* themselves are of course made of refractories with satisfactory abrasiveness.

The present inventors operated the apparatus according to the present invention shown in FIG. 1 as follows;

1 ton of molten SUS304 stainless steel was cast by a twin roll type continuous strip casting apparatus consisting of internal water cooling rolls made of steel drum having dimension of 400 mm diameter×300 mm width. BN (boron nitride) was used for the material of the side dam and the lowering speed was set to 10 mm/min. The dimension of the side dam was 150 mm width×300 mm length×20 mm thickness and the projecting amount into the roll width (shown by thickness $W_1$ in FIG. 2) was set to 10 mm. Further, the gap between the rolls was 2 mm. The circumferential surface of the roll was polished by #40 emery only by 10 mm width inward from the width end and the other portion was finished by a 3-S lathe. As a result, the stable casting was obtained and the strip width was maintained at about 290 mm from beginning to the end of the operation. The shape of the strip end was good. The side dams were lowered stably and smoothly ground by the rolls. The lower edge portions 13 of the side dams was further smoothly ground by the strip end. The whole casting time was 8 minutes without any abnormal damages of the side dams after casting.

What is claimed is:

1. A continuous casting apparatus for metal strip, in which a pair of internal cooling rolls rotating in the opposite direction to each other and having horizontal axes respectively are disposed opposite to each other and a pair of side dams are disposed spaced from each other by a distance approximately corresponding to the width of cast strip in order to form a metal pool on the circumferential surfaces of the pair of rolls, thereby continuously casting the metal strip from molten metal in the metal pool through the gap between the pair of rolls, characterized in that:

the side dams are disposed such that at least a portion of the bottom contacts the circumferential surface of the roll so as to allow at least a portion of thickness of the side dam to locate on the circumferential surface of the roll;

the bottom surfaces of the side dams contacting at least the circumferential surface of the roll during the casting are made of refractories having satisfactory abrasiveness:

a mechanism is provided for feeding the side dams in the casting direction at a predetermined speed; and the circumferential surface portion of the roll contacting the side dam is formed into a rough surface having grindability;

whereby the movement of the side dam by the feeding mechanism is carried out through the wear of the side dam ground by the rough surface.

2. A continuous casting apparatus for metal strip according to claim 1, wherein a portion of thickness of the side dam contacts the circumferential surface of the roll on the bottom thereof, the other portion of thickness of the side dam projects outward from the roll width, as viewed in the axial direction of roll the side dam area of the outward projecting thickness portion is larger than the area of the former portion contacting the circumferential surface of the roll, and the internal surface of the side dam in the projecting thickness portion contacts the side surface of the roll.

3. A continuous casting apparatus for metal strip according to claim 1 or 2, wherein said side dams are supported by side dam cases mounted to cover the outside surfaces of the side dams, said side dam cases being connected to the feeding mechanism.

* * * * *